US007089683B1

(12) United States Patent
Plestenjak

(10) Patent No.: US 7,089,683 B1
(45) Date of Patent: Aug. 15, 2006

(54) DRYING DEVICE

(76) Inventor: Jože Plestenjak, Yrhovci, c. VIII/7, 1000 Ljubljana (SI)

( * ) Notice: Subject to any disclaimer, the term of this patent is extended or adjusted under 35 U.S.C. 154(b) by 0 days.

(21) Appl. No.: 09/554,032

(22) PCT Filed: Mar. 30, 1998

(86) PCT No.: PCT/SI98/00008

§ 371 (c)(1),
(2), (4) Date: Aug. 1, 2002

(87) PCT Pub. No.: WO99/23430

PCT Pub. Date: May 14, 1999

(51) Int. Cl.
*F26B 19/00* (2006.01)

(52) U.S. Cl. ..... 34/209; 432/247

(58) Field of Classification Search ..... 34/202, 34/209, 210, 223, 224, 225, 220, 229, 230, 34/231, 232, 233; 432/66, 201, 247
See application file for complete search history.

(56) References Cited

U.S. PATENT DOCUMENTS

| | | | | | |
|---|---|---|---|---|---|
| 3,921,308 | A * | 11/1975 | Freze | 34/395 |
| 4,196,526 | A * | 4/1980 | Berti | 34/77 |
| 4,250,629 | A * | 2/1981 | Lewis | 34/380 |
| 4,955,146 | A * | 9/1990 | Bollinger | 34/191 |
| 5,119,571 | A * | 6/1992 | Beasley | 34/446 |
| 5,433,019 | A * | 7/1995 | Fu et al. | 34/381 |
| 5,680,711 | A * | 10/1997 | Moratalla | 34/77 |
| 6,321,460 | B1 * | 11/2001 | Jin | 34/77 |

* cited by examiner

*Primary Examiner*—S. Gravini
(74) *Attorney, Agent, or Firm*—Abelman, Frayne & Schwab

(57) ABSTRACT

The aim of the present invention is to create an efficient energy rational and consequently economical drying device, particularly the drying compartment unit, which could be used for drying processes for all wood products regardless to dimensions, with the ability of a controlled process of humid transfer from wood in specific atmospheric conditions by travel air, to achieve improvement of quality of drying wood, which include known drying effects, by the construction of the kiln volume proportional to fulfil dimensional and transport standards of transport containers, thus making possible the drying device being exploited by end user as a stationary or mobile type.

26 Claims, 4 Drawing Sheets

DRYING DEVICE

FIELD OF THE INVENTION

The invention relates to a drying device, particulary for drying wood and semi-products of wood like veneer or sawn wood as well as other products.

BACKGROUND OF THE INVENTION

A groving tree as a woody perennial plant contains relatively huge amounts of moisture content warying from one kind to another which stays in the tree after being cut down. As it is known wood contains capillaries in cells that contain free liquid and absorbed moleculas of water called moisture content which must be lowered to a certain level to satisfy needs of industrial use. For that reason, wood has to be properly treated, namely dried to a certain value of acceptable end moisture distribution content in a way to prevent occuring of all kinds of drying defects. The drying process is a mayor factor in economic terms.

Wood could be dried under natural circumstances in the open-air drying if wood climate relation conditions are good enough and consequently generating acceptable quality of dried sawn wood. It has to be considered that air drying of wood is a long term process which could extend into years. When finally wood is dried it needs proper storage conditions that include natural circulation of dry warm air and other terms of planning. It has to be considered that absorbed water in the wood can emerge and evapoprate with the help of sourrounding air flow only in case if the surface is not covered by rain fall water, snow or other substances. Influencing on air drying tehnology by restacking with ventilation abilities do help in minor values with the constant risk of wood being attacked by mould, microoorganismus, fungi insects including uneven drying that can worsen quality of wood expresed with other terms concerning its quality. There is always a potential problem of shape deformations that can emerge because of natural air-drying unpredictable situations that cannot be prevented by any preventive process control tehnology or monitoring of any kind. Moisture distribution content in wood is by using technology of drying by air after a certain period of time depending on climate conditions what means that time variation is present in planning emerging other problems usually leading to higher costs, too much rejections of quality assurance and alike. On the other hand there are also some other efects of such a technology like low energy consumption, huge drying areas, storage departments, safety procotions. There were some expriments executed to shorten air-drying process by engaging axial fans, but there are too many other parametres like relative humidity and others on which axial fans cannot influence.

With the intention to reduce drying time in the aspect of cost, quality and time were developed drying devices of different kinds, which can be distinguished by a technological approach in a following manner: The first type is a compartment type and tunnel kiln type. Both known types of drying devices can be characterized as stationary types. By the first type of drying devices the wood is placed in avaliable compartment which has the ability of generating different physical conditions like: temperature, humidity, air flow capacity and alike, with the intention of proceeding of the drying process. By the second type of drying devices the wood is transported with the help of horizontal transport unit through the drying device where it is sequently processed under different physical conditions, mainly for the purposes of gradualy executing the drying process. Compartment type drying devices are cheaper, but with lower production rate in comparison with the tunnel kiln type drying devices, where investment costs are relatively high.

The already known types of drying devices have certain disadvantages which will be explained in details as follows including the decisions of great investment cost and setting up difficulties in aspect of economy factors.

The technology processes used nowadays by drying the wood are performed either by low temperatures between 15 and 45° C. or by medium temperatures between 45 and 90° C. or also by high temperatures between 90 and 130° C. with the posibility of achieving above specified temperatures e.g. by means dielectrical, convectional, conduction or radiation principles.

By certain types of drying devices the wood is put into compartment by means of suitable transport carriages. With the ventilators placed on the ceiling or rarely on other locations an air flow is created which is in some cases blown transversely, yet by others the air flow is lead horizontaly and transversely and still in other versions the air is lead longitudinaly.

By all these known drying devices the transport units are constructed in a manner and with such dimensions that enable loading as great quantities of wood as possible in the kiln volume. The wood is stacked by along ventilation in a way that air flow is possible at least in one horizontal plane. A certain compromise has to be achieved with the consideration of dimensions of the air gap that is neccessary for air flow and the amount of wood in the kiln. The hot air is then blown through the air gaps in order to fasten up the intensity of drying. When the hot air gets in contact with the wood containing high moisture level it absorbs it to its highest possible value, what causes enabling of absorption of moisture, that is still present deeper in the pile. Consequently that means that ventilators create enough strong air flow yet with the highest moisture level possible what means only a lot of waste of energy. Because of high moisture level in the air it is very likely that it condenses on cooler places such as walls and other equipment causing damage. The condensed liquid that stays in the kiln volume efects harmfull on it as well as to the drying process.

As noted in the patent aplication EP 0 170 648 A1 which is intended to execute one of the latest drying technologies the compartment has warm-insulated walls. The sawn wood is being stacked by longitudinaly ventilation in the kiln volume. In the drying device there is installed a ventilator which enables air flow passing through a heating register then continuing on trough stacked wood to the cooling register where the air flow is led in a way of repeating the same loop. In the area of heating register the air is warmed up then as passing trough the stacked wood it picks up moisture which is then released by passing trough the colling register to the warming register. Such a combination is likely to create condensate if fresh sawn wood is processed but is quite suitable for wood with low moisture volume—the final touch—before being used up by industry.

If desired that by means of satured air generated by drying process of stacked wood as highest as possible quantity of moisture should be departed from compartment, the air must be heated. The disposal of great amounts of saturated air is combined with great looses of heat used before as heating air. Energy yield by using this technology of drying wood is low.

Except of the above mentioned drying technologies also a vacuum drying technology is described in the PCT/DK87/00012 and WO 87/04779, where e.g. intensivity of drying process could be monitored in order to avoid drying defects. The devices with applied vacuum technology are very sensitive in mantaining proper vacuum conditions and are more suitable for drying processes for wood containing lower values of moisture what means that other drying technology for eliminating the majority of moisture has to be used therebefore.

By all these known solutions it can be summarized that all of them have certain imperfections, e.g. relatively low energy yield being unacceptable for global economy, or high requirements in respect of the space consumption, highly dependance on power sources, a high probability of drying defects, very small or no adaptable abilities and are moreover built as a stationary type with drying capacities that dictate the amounts of drying wood and technology.

SUMMARY OF THE INVENTION

According to the invention, the drying unit is provided by an aerated housing, the inner area of which is connected by the circumferential area by means of exhausting conduits and aerating conduits. Thus, in accordance with the principals of the invention, the new drying device is created on the basis of many ventilation air systems containing different type of airflow intake as well as disposal air possibilities that are fixed to the drying device. Such a device is equipped by a heat condensation device containing a heating unit, a condensation unit and a ventilator. The drying device has a drying kiln in which with the help of transporting carriage is placed wood intended to be dried. The drying process is executed in the drying kiln by enforced circulating air. At least one wall of the kiln compartment is equipped by suitable air shafts for aerating or exhausting functions as an integrated unit of the drying device including the system vent which has the function of air pre-orientation in any time required during the drying process in coinsistence with air deflector placed above the loading volume integrated in the kiln compartment by the heat condensation unit, which extends from the opposite side of the drying compartment and ends at the bottom of the kiln cmpartment. The air deflector by the heat condensation device has mounted at least one vent, which could be self-adjustable and an integrated unit consisting of a partition wall and the top of kiln volume, which in combination with the top of the kiln compartment presents a tunnel-shaped air shaft in which the ventilation system is placed. The whole above mentioned section is called an air deflector. The already mentioned air shafts start on the micro climate vent mounted on the top of the kiln compartment, then they are lead mainly along the side wall and are ended within the space of the kiln volume.

In the kiln volume there is arranged at least one ventilation unit with the ability of angular adjustment with the posibility of positioning it either in the on- or in the off-state function. With the microclimate went in closed position connected with the air shafts, ranging from the top of the kiln compartment ending in the kiln volume are generated conditions for creating an internal air circulation, but in open position the internal circulation gets in contact again with the help of the shafts with external athmosphere with paralell air flow of mostured air blown out of the kiln volume in the athmosphere and sucked in fresh dry air in the tunnel shaped air shaft due to the pressure difference. In the tunnel-shaped air shaft is recommended an instalation of heating elements.

In accordance with the invention is the unit for stacking wood or other products intended for drying also equiped with accessories that enable vertical and horizontal stacking and longitudinal ventilation. The accessories also enable vertical positioning of dominant surfaces of the drying wood. The distance holders that enable stacking of wood are placed vertically in relationship to each another and are shorter than the vertical supports of the unit. The said units can be mounted one on each other. The botton carriage can be equiped by transport wheels. In accordance with the present solution in the kiln compartment space close to the micro climate vent is placed an UV-emittor meant for emitting ultra-violet rays to the moisture contained in the air with the intention of eliminating the posibility of development culters like mould, fungi and other microorganismus.

In accordance with the principals of the invention is the new drying device equiped with magnets assembled in the kiln compartment in bipolar arrangement what means that magnetization treatment influences on all the processes—chemical, phyisical and biological.

According to the invention, the drying device also comprises a heating condensation device with a ventilator assembled in the opening of partition wall. The heating condensation device is designed in a way of iregular medium flow linking to increase condensation efect as well as heating emission.

Now, the invention will be described in more detail on the basis of an embodiment as shown in the accompanied drawings, where

DETAILED DESCRIPTION OF PREFERRED EMBODIMENTS OF THE INVENTION

Figure 2:
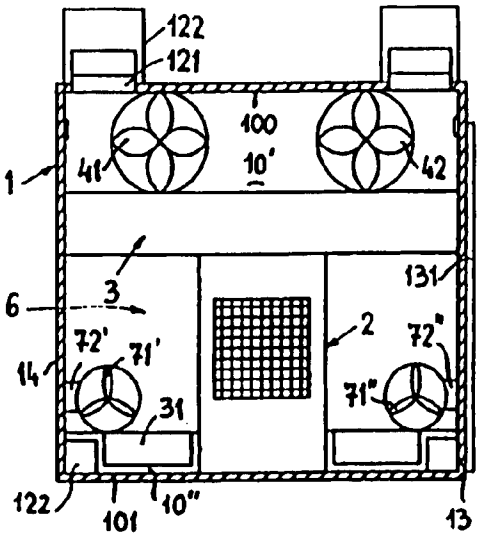
FIG. 2 is a transversal cross-section of the device in the vertical plane.
Figure 1:
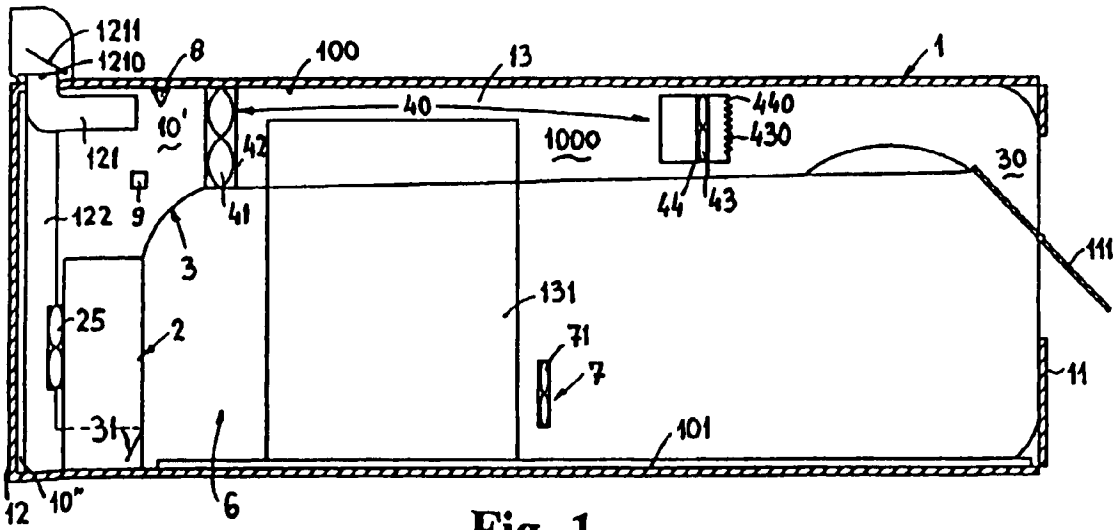
FIG. 1 is a longitudinal cross-section of the drying device in a vertical plane.
Figure 3:
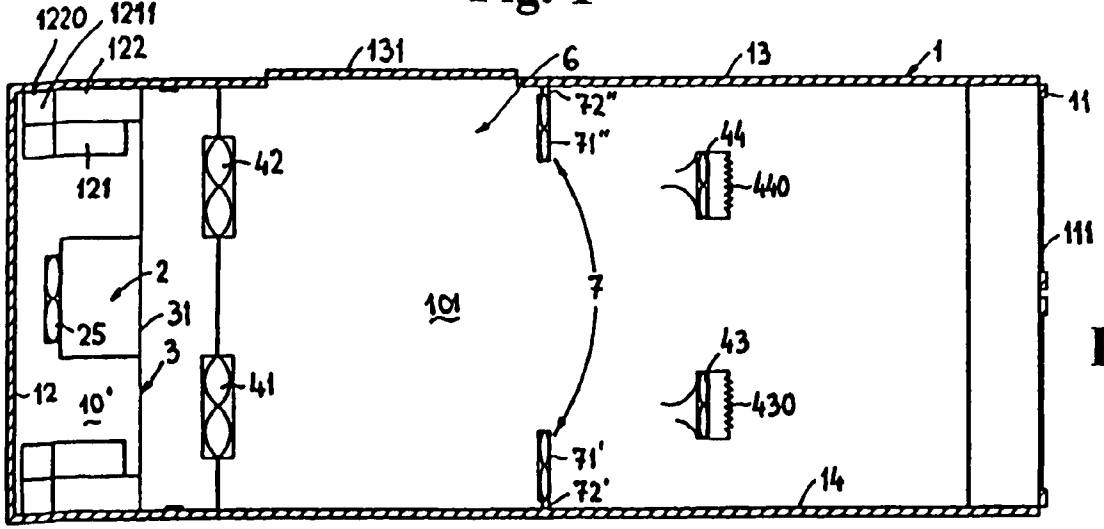
FIG. 3 is a longitudinal cross-section of the device in a horizontal plane.

A drying device shown in FIGS. 1–3 is in generally designed for drying wood and other materials with the kiln compartment 1 constructed as to fulfill standards and other requirements known in the field of transport where standard containers are used for all known transport posibilities. The proportions of the kiln compartment 1 have certain advatages comparing with all till now known drying devices as well as certain limitations, which may be however overcome by the solution according to the invention. In such a manner it is possible to exploit the drying device by the user either e.g. as a stationary or a mobile device with extremely quick and simple installation to appropriate location.

At least one of the side walls 11, 12, 13, 14 of the kiln compartment 1, namely in this case the longitudinal wall 13, is equiped by a suitable door 131, allowing e.g. to enter the kiln compartment 1 and being e.g. intended for personal access. On the other hand, by the shown embodiment the wall 11 is equipped by a lifting loading door, in which is in this case fixed at least one system vent 111, which is otherwise arranged in the area of the said wall 11. In accordance with the general idea of the invention will the role of the system vent 111 be explained in more detail as follows.

On the opposite side of the kiln compartment 1, namely on the top of the wall 12, there are fixed suitable integrated micro climate vents 1211 equiped with appropriate exaust funnels 1210, 1220 of the aerating respectively exhausting air shafts 121, 122 as a way by which the interior of the kiln compartment is connected with the external athmosphere. With the help of the micro climate vent 1211 the air shaft 121 connects or disconnects the exterior athmosphere and the interior area 10' near the top 100 of the kiln compartment 1; analogous the air shaft 122 is connected in the same way with the help of appropriate micro climate vent 1221 to external atmosphere and the interior space 10" near the bottom 101 of the kiln compartment 1 in a certain distance with respect to the back wall 12, where is also placed a heat condensation device 2. By using the micro climate vent 1211 great advantages are obtained in cases when performing the drying program is in automatic mode.

Figure 8:
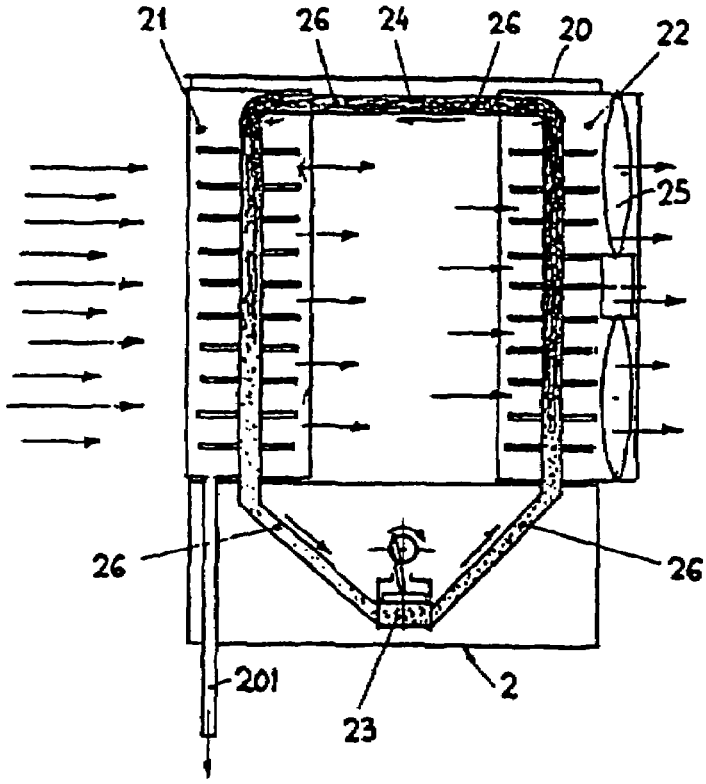
FIG. 8 shows a condesation unit of the device according to the invention.

The heating condensation device 2 is schematically shown in the FIG. 8 and consists of the folowing parts: a housing 20 equiped with an outlet 201 for condensate, a condensation unit 21, a heating unit 22, a compressor 23 and a throttle, which are mutually connected in appropriate circuit 26 together with condensation unit 21 and heating unit 22 and a ventilator 25 which enables an air flow from condensation unit 21 to heating unit 22 continuing on in the same direction towards other interior areas of the kiln compartment 1. Such a heating condensation device 2 enables that warm moistured air with the help of condensation unit 21 reduces the amount of moisture in it formed as condensate flowing out trough a escape-pipe 201. The air is warmed up in the heating unit 22 for approximately 2° C. with respect to temperature of the air entering the kiln volume from its circumferential area.

In the kiln compartment 1 is asembled the top of the kiln volume, partition wall with an air deflector 3 close to the heat condensation unit 2 in a certain distance from the side wall 12 which is connected with the bottom area 101 of the kiln compartment 1. The air shafts 121, 122, and heat condensation device 2 are placed between the side wall 12 and the top area 100 with the air deflector 3 placed under the top area 100 of the kiln compartment 1 in a certain distance from the top area 100 extending to the door 11 with the system shaft 111 of the kiln compartment 1. The top area 100 with air deflector 3 is positioned in relationship to top 100 and door 11 with the system shaft 111 of kiln compartment 1 in a way to close the passage 30 between the top 100, side wall 112 and the top with air deflector 3. The system shaft 111 can be led in automatic mode.

The shape and the position of the air deflector 3 placed under the top area 100 enable forming a tunnel shaped air shaft 1000, in which is placed the ventilation unit 40 comprising two properly spaced ventilators 41, 42 installed near the air shafts 121, 122 with the possibility of two more ventilators 43, 44 placed in the middle part of the kiln compartment 1 equiped also with heating elements 430, 440.

Under the top and air deflector 3 is in the space between the bottom 101 and system vent 111 and the wall respectively the loading doors 11 and the rest of the kiln volume 6 do offer enough large kiln volume that loading of at least one ore more carriages with stacking units 5 is possible on which is stacked wood or other materials intended to be dryied. In accordance with the principle of the invention will all details considering position 5 be explained as following.

In the drying device there is also installed at least one ventilaton unit 7 consisting of at least one ventilator 71 with the ability of angular disperson 72 of the current air flow. In position when ventilator is arranged parallel to adjacent side wall of the kiln compartment 1 is in inactive state and—vice versa—when being swung in another position it is in the active state. Ventilator has to be swung in its inactive state e.g. when the carriages 5 are moved along the kiln volume 6 for whatever the reason. Two ventilators 71', and 71" as shown in the FIG. 3 are separately arranged on appropriate supports 72', 72" each at the one side of the longitudinal side walls 13, 14 of the kiln compartment 1.

Figure 7:
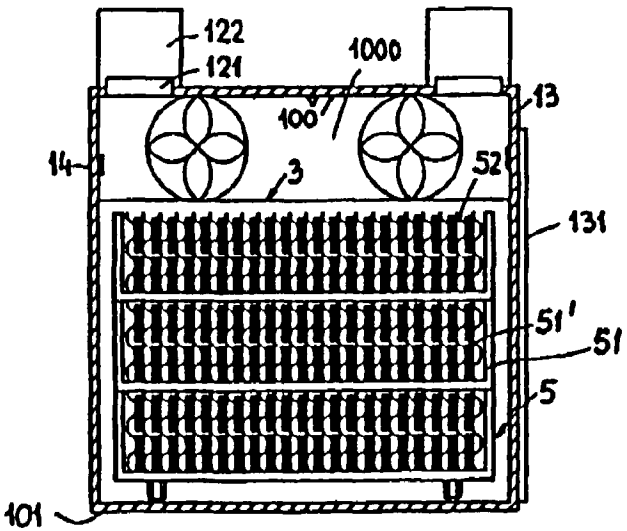
FIG. 7 is a transversal cross-section of the drying device according to FIG. 5.
Figure 9:
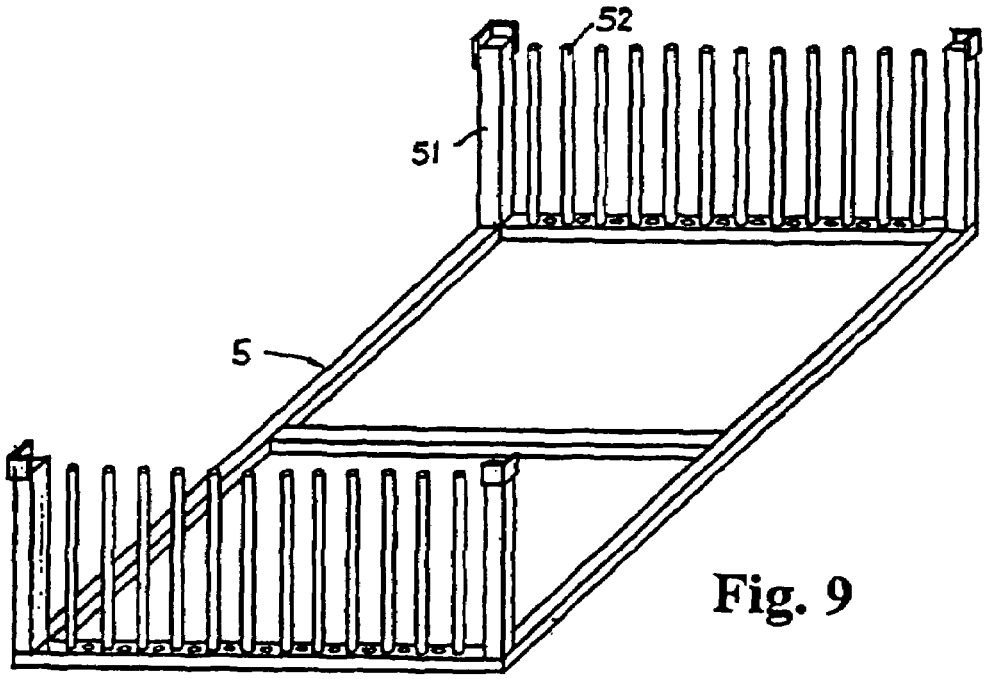
FIG. 9 shows a unit for stacking wood also comprised by the device according to the invention.

The carriage stacking unit 5 for wood as shown on FIG. 9 is equiped by wheels and foreseen for placing into the kiln volume 6. The carriage stacking unit 5 is in accordance to the invention constructed in such a way that it enables stacking the wood in a vertical position with the help of vertical distant elements 51 that also enable vertical stacking 52 with ensuring stacking through the width in specific degree. At least one stacking unit 5 is equiped by wheels 50 on FIG. 4 with the recommendation of having more stacking units. In this way it is possible to mount one on each other separate stacking units 5 equipped by wheels 50 to die required height. In this way as shematically shown on FIGS. 5 and 7 is achieved stacking in vertical and horizontal direction in the required value through out the kiln volume 6 what consequently ensures good air permeability.

According to the invention it is most suitable to choose stacking of wood in the kiln volume 6 on the stacking units 5 in a way to achieve that dominant surfaces of wood are in arranged in a vertical plane. Parts of wood of smaller width needs to be stacked in the stacking unit 5 by being put one on each other in a vertical position with ensured air gap distance between the wood by means of appropriate distance element 51'.

In accordance with the invention is moreover in the kiln compartment 1, more exactly in the area 10', a UV-radiation device 8 is mounted, which is preferably an emitor of ultra-violet and is foreseen for emitting of UV-rays to the moisture contained in the air with the intention of eliminating the posibility of development cultures like mould, fungi and other microorganism.

In the kiln compartment 1 in the area 10' there are furthermore available at least two magnets 9 in bipolar arrangement where magnetization treatment influences on all processe—chemical, phyisical and biological and on properties of all moisture that is present in the kiln volume 1.

Figure 4:
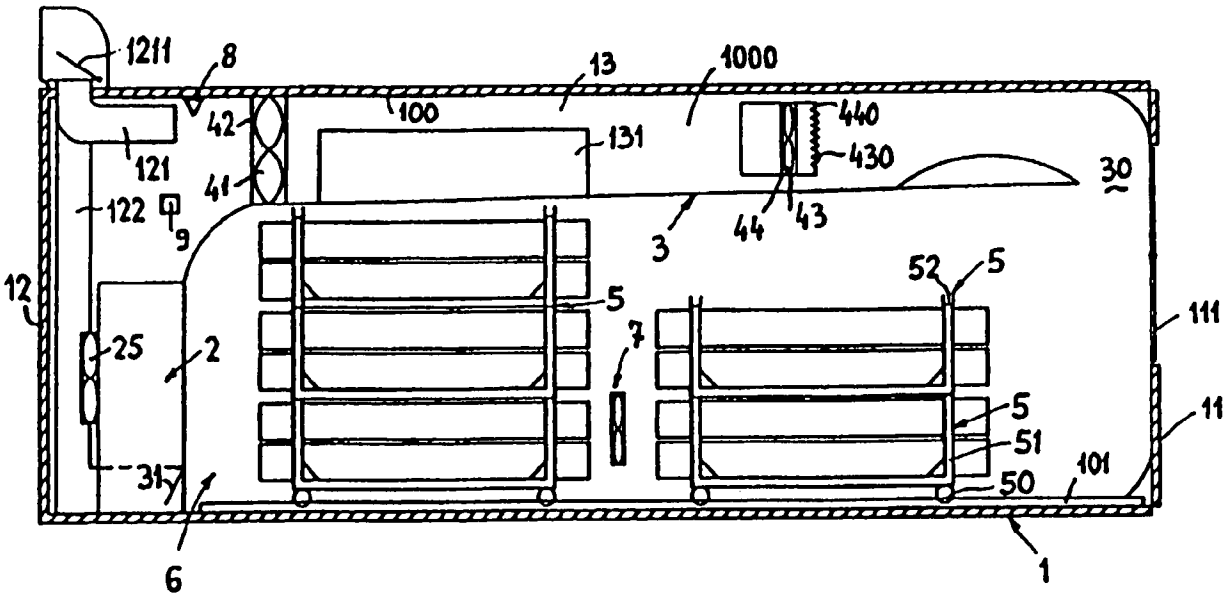
FIG. 4 is a longitudinal cross-section of the device in the vertical plane, however during its operation mode comprising combination of dehumidification drying and convection drying with the wood stacked to enable ventilation in the longitudinal direction.
Figure 5:
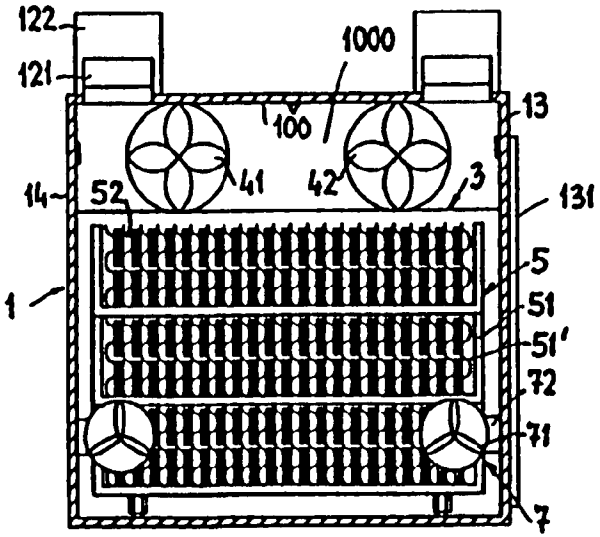
FIG. 5 is a transversal cross-sestion of the device according to FIG. 5 in its vertical plane.

In accordance with the invention the drying device on FIGS. 4 and 5 enables an integrated drying process of dehumidification by condensation-convection method in a way as explained before. The wood intended to be dryied is put into kiln volume 6 by opening loading lifting dooors 11 on staking units 5 on which is properly staked wood with accessories 51, if needed also with vertical distance elements 51' and horizontal distance elements 52. A thin layer of wet substance sticked to rough surface of sawn wood is present on wood in this phase preventing further lossing of moisture content from wood. After the wood is put in the kiln volume 6 and the doors 11 closed the proces of drying is started by activation of ventilators 41, 42, 43, 44, ventilation unit 40, ventilator 25 attached to the heat condensation unit and activated ventilators 71. The system vent 111 assembled in the wall respectively the door 11 is closed. The heat condensation unit 2 is activated and appropriate air circulation is generated on a preset temperature value achieved by activating heating elements 430, 440 of the ventilation unit 40. When the conditions correspond to those as required, the heating elements 430, 440 are disactivated and the required heat may be supplied only with activated heat condensation device 2. With the intention of acceleration of the drying process appropriate circulation of suitable warmed up air has to be established. When moisture present on/in the wood is absorbed by the air it is lead through the heat condensation device 2 where it is eliminated with the help of condensation unit 21 as shown in the FIG. 8 and thereafter led out of the device by means of the escape pipe 201. In this phase can the kiln compartment 1 be connected with external air by means of air shafts 121 and 122. When passing trough the heat condensation device 2 the air is warmed up to a certain degree and sucked by ventilators 25 and 41, 42, 43, 44 in a circulating movement trough the tunnel shaped air shaft 1000 where it is heated up if necessary by means of appropriate heating elements 430 and 440 threafter it passes trough the passage 30 and by the system vent 111 and air deflector 3 entering in the kiln volume 6 where it is lead by ventilators 17 depending on the configuration of the wood that is stacked on carriage stacking units 50.

The drying conditions enable an intensive transfer of moisture from wood to the circulating air. Through the air shaft 122 the air emerges from the kiln volume 6 and the kiln compartment 1 outwards to the external atmosphere. As it is known from the science, the coller air enriched with moisture has downstream tendency, in this case therefore towards the bottom 101 of the kiln compartment 1. However, due the pressure difference is simultaneously the emerged air through the air shaft with the help of micro climate vent 1211 replaced by fresh air containing less moisture through the air shaft 121.

The rest of the air available in the kiln volume 6 passes trough the heat condensation unit 2 where moisture from the air is released by the help of condesing unit 21 and partially dried and heated up by means of the heating unit 22 to the desired degree emerges entering the tunnel air shaft 1000 with the help of all ventilators starts a new circulating cycle by entering into the kiln volume 6. The drying mode as described enables especially at the beginning when a lot of free water is present on the wood and in it an eficient way to dry wood without heating it up to high temperature causing possible drying defects known by drying in the past.

In order to achieve predefined and controlled value of air moisture with the above described drying technology in the kiln compartment 1 and the kiln volume 6, now the drying conditions have to be changed. As it is known, the wood contains capillars in cells that contain free liquid and absorbed molecules of water called moisture content which by being lowered if applying the right drying technology must be executed in the proper climate conditions depending mainly on the kind of wood and varying essentially from kind to kind, where circulating air should always be capaple of reducing moisture content, constantly emerging from the drying wood.

Figure 6:
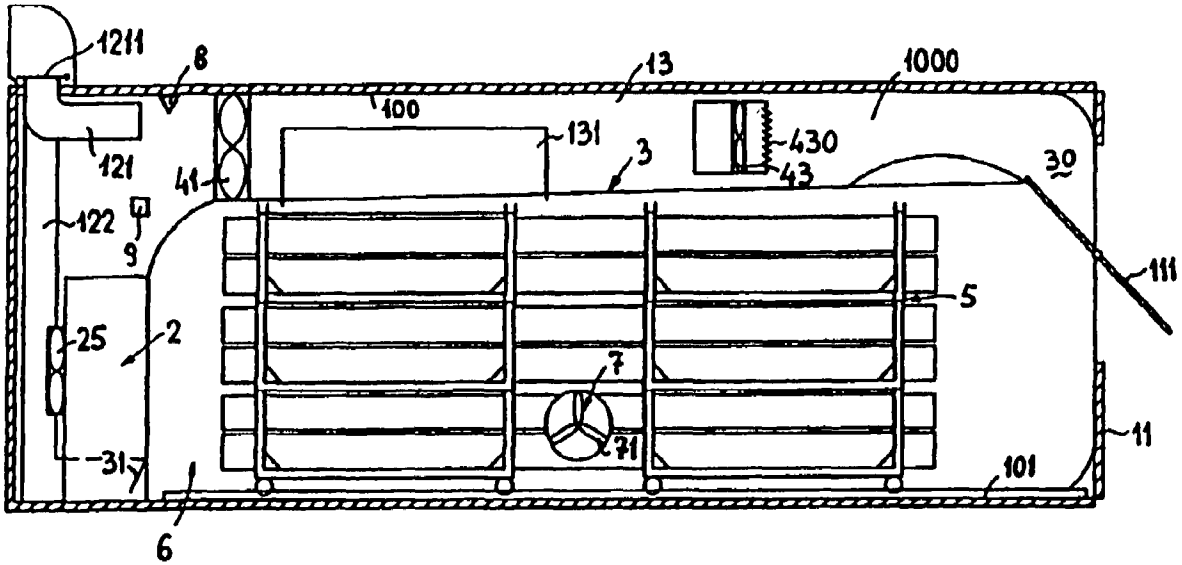
FIG. 6 is a longitudinal cross-section of the device according to FIGS. 1–3, however during its further operation mode suitable for accelerated process of natural air drying, again with the stacked wood.

In the above mentioned way it is possible to execute drying in a simple and surprisingly short time by the new developed drying device in kiln volume 6 without engaging acsessories of any kind and restaking processes of wood and without additional heating of air. The air passes through the passage 30 near the air deflector 3 and the system vent 111 is opened as shown on FIGS. 6 and 7 in consideration that in most cases adittional heating of air is not needed, even functional exterminated the implementation of the new developed drying process can be executed. The micro climate vent 1211 and the air shafts 121 and 122 are by implementation of new developed drying manner in their closed position.

Therefore, according to the invention, the difference comparing to known solutions of drying processes is physical prevention of repeted circulation and mixing of dry and saturated air what would cause low efficiency. The activated ventilators 41, 42, 43, 44 of the venting unit 40, ventilator 25 of the heat condensation device 2, and ventilators 71 generate appropriate air circulation. The external air led into the kiln compartment 1 and consequently into the kiln volume 6 passes through the system vent 111, which is opened, and is thereafter led through the kiln volume 6 and through a self-adjustable vent 31 and after that through the heat condensation device 2 containing heating unit 22 is mostly or even permanently functionally exterminated but with the help of ventilator 25 is led through the tunnel-shaped air shaft 1000 to the air passage 30. When the system vent 111 is in the opened position the air emerging from the air passage 30 cannot reenter the kiln volume 6 but is exhausted from the kiln compartment 1 to the external athmosphere. In this way it is achieved that only a dry fresh air has the ability to get in contact with the drying wood. Those skilled in the art should understand that the intaken fresh air would have to be treated in certain ways in cases of extreme climate conditions what can be done with the help for this meant accessories what does not influence on the principle of the invention.

The invention claimed is:

1. A drying device for removing moisture from moisture-containing materials placed inside the drying device, the drying device comprising:

a) a kiln compartment (1), having a plurality of side walls (11,12,13,14), a top wall (100), and a bottom wall (101), that define a kiln volume (6), for holding material to be dried, the kiln compartment (1) further having at least one loading door (131) through which the material to be dried is placed into the kiln compartment (1);

b) at least one system vent (111), movably positioned in at least one side wall (11,12,13,14), and communicating between the kiln compartment (1) and the exterior of the drying device;

c) a heat condensation device (2), including a housing (20), containing a condensation unit (21), a heating unit (22), and at least one ventilator (25), positioned in at least one side wall (11,12,13,14) opposite to and different from the side wall (11,12,13,14) in which the at least one system vent (111) is positioned;

d) an air deflector (3), positioned in an upper zone of the kiln volume (6) in the kiln compartment (1);

e) a tunnel-shaped air shaft (1000), extending horizontally along the kiln compartment (1) proximate to the top wall (100), and forming an air passage (30) between the air deflector (3) and the system vent (111); and f) a ventilation unit (40), positioned in the tunnel-shaped air shaft (1000), for drawing air into the tunnel-shaped air shaft (1000);

such that a volume of dry air is circulated in the kiln compartment (1) by a plurality of ventilators to absorb moisture from the material to be dried.

2. The drying device according to claim 1, further comprising at least two aerating and exhausting shafts (121,122), and a micro climate vent (1211), which is attached to one of the plurality of side walls (12) of kiln compartment (1), such that both aerating and exhausting shafts (121, 122) are connected to the micro climate vent (1211), proximate to the air deflector (3), and such that the aerating and exhausting shaft (121) is positioned such that it communicates between the kiln compartment (1) proximate to the top (100) thereof and the exterior of the drying device, and such that the aerating and exhaustion shaft (122) is positioned such that it communicates between the kiln compartment (1) proximate to the bottom (101) thereof and the exterior of the drying device.

3. The drying device according to claim 1, further comprising at least two aerating and exhausting shafts (121,122), and at least two micro climate vents (1211,1221), which are attached to one of the plurality of side walls (12) of the kiln compartment (1), such that both aerating and exhausting shafts (121,122) are connected to micro climate vent (1211) arranged adjacent to the side wall (12) of the kiln compartment (1).

4. The drying device according to claim 1, further comprising at least one additional ventilation unit (7), including ventilator (71), positioned in the kiln volume (6) on an adjustable support (72), for enabling angular dispersion of air flow, and such that the ventilation unit (7) is in an off mode when placed parallel to one of the plurality of side walls and is in an on mode when placed nonparallel to one of the plurality of side walls.

5. The drying device according to claim 2, further comprising at least one additional ventilation unit (7), including ventilator (71), positioned in the kiln volume (6) on an adjustable support (72), for enabling angular dispersion of air flow, and such that the ventilation unit (7) is in an off mode when placed parallel to one of the plurality of side walls and is in an on mode when placed nonparallel to one of the plurality of side walls.

6. The drying device according to claim 3, further comprising at least one additional ventilation unit (7), including ventilator (71), positioned in the kiln volume (6) on an adjustable support (72), for enabling angular dispersion of air flow, and such that the ventilation unit (7) is in an off mode when placed parallel to one of the plurality of side walls and is in an on mode when placed nonparallel to one of the plurality of side walls.

7. The drying device according to claim 1, wherein the system vent (111) is positioned on one of the plurality of side walls (11) of the kiln compartment (1), adjacent to the door (131) of the kiln compartment (1), the system vent being capable of alternatively assuming a closed position and an open position, such that when the system vent (111) is in the in the closed position, there is enabled an internal circulation of air flow from the tunnel-shaped air shaft (1000) in the area between the top (100) of the kiln compartment (1) and the air deflector (3), passing through the air passage (30) between the air deflector (3) and the wall adjacent to the door (131) in the kiln volume (6) in a direction towards the self adjustable vent (31) and under the air deflector (3) towards the heat condensation unit (2), since in the case when the system vent (111) is opened the air flow is passing from the tunnel shaped air shaft (1000) through at least two gaps formed by opening the system vent (111) the air is blown out of kiln compartment (1) in open space on the upper side trough at least one gap and simultaneously the fresh air is sucked from outside directly into the kiln volume (6) through at least one lower gap.

8. The drying device according to claim 1, wherein the ventilation unit (40) further comprising a plurality of ventilators (41,42,43,44), which are positioned in the tunnel-shaped air shaft (1000) between the air deflector (3) and the top wall (100) of the kiln compartment (1), such that at least one of the ventilators (41,42,43,44) is equipped with at least one corresponding heating unit (430, 440), provided for heating the air in the tunnel-shaped air shaft (1000).

9. The drying device according to claim 8, wherein there are four ventilators (41,42,43,44), arranged in two pairs of two, arranged side-by-side, such that a first pair of ventilators (41,42) is positioned in the tunnel-shaped air shaft (1000) towards one end of the kiln compartment (1), and a second pair of ventilators (43,44) is positioned in the tunnel-shaped air shaft (1000) towards an opposite end of the kiln compartment (1), and further such that two of the ventilators (43,44) are provided with corresponding heating units (430, 440).

10. The drying device according to claim 1, further comprising a plurality of carriage stacking units (5) for containing the material to be dried, each carriage stacking unit (5) having a plurality of vertical elements (51), spaced apart from one another, and a plurality of horizontal elements (52), spaced apart from one another.

11. The drying device according to claim 10, wherein at least one of the carriage stacking units (5) is equipped with wheels (50).

12. The drying device according to claim 10, wherein the carriage stacking units (5) are stackable one on top of another.

13. The drying device according to claim 11, wherein the carriage stacking units (5) are stackable one on top of another.

14. The drying device according to claim 1, further comprising a condensate outlet pipe (201), mounted in the housing (20) of the heat condensation device (2), for outlet of condensate formed by the cooling of moist air in the condensation unit (21), a compressor (23), and a throttling valve (24), such that the condensation unit (21), the heating unit (22), the compressor (23) and the throttling valve (24), form a closed circuit through which a thermally conductive fluid is circulated.

15. The drying device according to claim 1, wherein the kiln compartment (1) is constructed to have standardized dimensions of a container for international container transports.

16. The drying device according to claim 1, wherein the vent (31) of the air deflector (3) is self-adjusting.

17. The drying device according to claim 1, further comprising a radiation device (8), placed in an interior of the kiln compartment (1), proximate to the venting and exhausting shafts (121,122).

18. The drying device according to claim 17, wherein the radiation device (8) is an emitter of ultra-violet rays.

19. The drying device according to claim 1, further comprising at least two magnets (9), which are positioned in the kiln compartment (1).

20. The drying device according to claim 19, wherein the magnets (9) are permanent-magnets.

21. The drying device according to claim 20, wherein the at least two permanent magnets (9) in the interior of the kiln compartment (1), are positioned adjacent to the exhausting and aerating shafts (121,122) and the air deflector (3), and provide a bipolar magnetic field.

22. The drying device according to claim 9, wherein the distance between adjacent vertical distant elements (51), viewed in a horizontal direction, is shorter than the distance between adjacent side vertical supports (52).

23. The drying device according to claim 6, wherein the vertical distance elements (51) and the horizontal distance elements (52) of the stacking unit (5) are spaced apart from one another a sufficient distance and layers of material to be dried placed inside the stacking unit (5) are spaced apart from one another a sufficient distance to form an air gap between distance elements (51,52) and between layers of the material to be dried, to enable circulating drying air to flow between the distance elements and between layers of material to be dried.

24. The drying device according to claim 22, wherein the vertical distance elements (51) and the horizontal distance elements (52) of the stacking unit (5) are spaced apart from one another a sufficient distance and layers of material to be dried placed inside the stacking unit (5) are spaced apart from one another a sufficient distance to form an air gap between distance elements (51,52) and between layers of the material to be dried, to enable circulating drying air to flow between the distance elements and between layers of material to be dried.

25. The drying device according to claim 1, wherein the microclimate vent (1211) is actuated when there is an increase in the moisture content of the air at the top (100) of the kiln compartment (1), and such that the vent (1211) operatively cooperates with air shafts (121,122), such that it is connected with the kiln volume (6) by the air shaft (122), through which air is exhausted; and such that it is connected with air shaft (121) whereby when a pressure differential exists, fresh outside air is taken-in to the area (10'), and further such that when the microclimate vent (1211) is inactivated, the drying process is isolated from external atmospheric air and internal air circulation is generated in the kiln compartment (1).

26. The drying device according to claim 1, wherein the microclimate vent (1 211) is actuated when there is an increase in the moisture content of the air at the top (100) of the kiln compartment (1), and such that the vent (1211) operatively cooperates with air shafts (121,122), such that it is connected with the kiln volume (6) by the air shaft (122), through which air is exhausted; and such that it is connected with air shaft (121) whereby when a pressure differential exists, fresh outside air is taken-in to the area (10'), and further such that when the microclimate vent (1211) is inactivated, the drying process is isolated from external atmospheric air and internal air circulation is generated in the kiln compartment (1).

* * * * *